US005878602A

United States Patent [19]

Kovich et al.

[11] Patent Number: 5,878,602

[45] Date of Patent: Mar. 9, 1999

[54] VERTICAL AXIS WASHER AND A ROTATING WASHPLATE THEREFOR

[75] Inventors: Mark B. Kovich; Tracy M. Smart, both of St. Joseph, Mich.; Earl E. Meister, III, Granger, Ind.; Katrien A. Saveyn, Stuttgart, Germany

[73] Assignee: Whirlpool Corporation, Benton Harbor, Mich.

[21] Appl. No.: 935,852

[22] Filed: Sep. 23, 1997

[51] Int. Cl.[6] ..... D06F 17/10

[52] U.S. Cl. ..... 68/134

[58] Field of Search ..... 68/23.6, 23.7, 68/133, 134

[56] References Cited

U.S. PATENT DOCUMENTS

| | | | |
|---|---|---|---|
| 2,575,691 | 11/1951 | Smith | 68/23 |
| 2,659,226 | 11/1953 | Pellerin | 68/133 |
| 3,087,776 | 4/1963 | Anderson | 8/159 |
| 3,095,721 | 7/1963 | Bochan | 68/133 |
| 3,233,436 | 2/1966 | Gibson | 68/133 |
| 3,406,543 | 10/1968 | Trouilhet | 68/132 |
| 3,943,736 | 3/1976 | Carin | 68/133 |
| 4,464,914 | 8/1984 | Torita | 68/23.5 |
| 4,483,161 | 11/1984 | Oida | 68/23.6 |
| 4,495,784 | 1/1985 | Ikeda | 68/23.6 |
| 4,862,710 | 9/1989 | Torita et al. | 68/12 |
| 5,193,361 | 3/1993 | Singh et al. | 68/17 |
| 5,205,141 | 4/1993 | Singh | 68/53 |
| 5,239,847 | 8/1993 | Lee | 68/134 |
| 5,381,677 | 1/1995 | Park et al. | 68/23.7 |
| 5,460,018 | 10/1995 | Werner et al. | 68/23.6 |

FOREIGN PATENT DOCUMENTS

| | | | |
|---|---|---|---|
| 1.186025 | 12/1959 | France | D06F 13/02 |

OTHER PUBLICATIONS

Patent Abstracts of Japan vol. #14, No. 123, 8 Mar. 1990 & JP01 320089A (Toshiba Corp) Dec. 26, 1989.

Patent Abstracts of Japan vol. #96, No. 012 & 26 Dec. 1996 & JP08 215483A (Sharp Corp) Aug. 27, 1996.

*Primary Examiner*—Philip R. Coe

*Attorney, Agent, or Firm*—Thomas A. Schwyn; Andrea Powers Denklau; Joel M. Van Winkle

[57] ABSTRACT

An automatic washer having a wash tub in which a rotatable wash basket is disposed. A wash plate is rotatably mounted in the wash basket and is capable of independently rotating or co-rotating with respect to the wash basket. The wash plate has at least two ripples integrally formed in its surface whereby upon the rotation of the wash plate, any clothing in contact with the ripple will be directed vertically to impart mechanical energy to the clothing instead of carrying the clothing with the wash plate as it is rotated.

36 Claims, 4 Drawing Sheets

FIG. 3
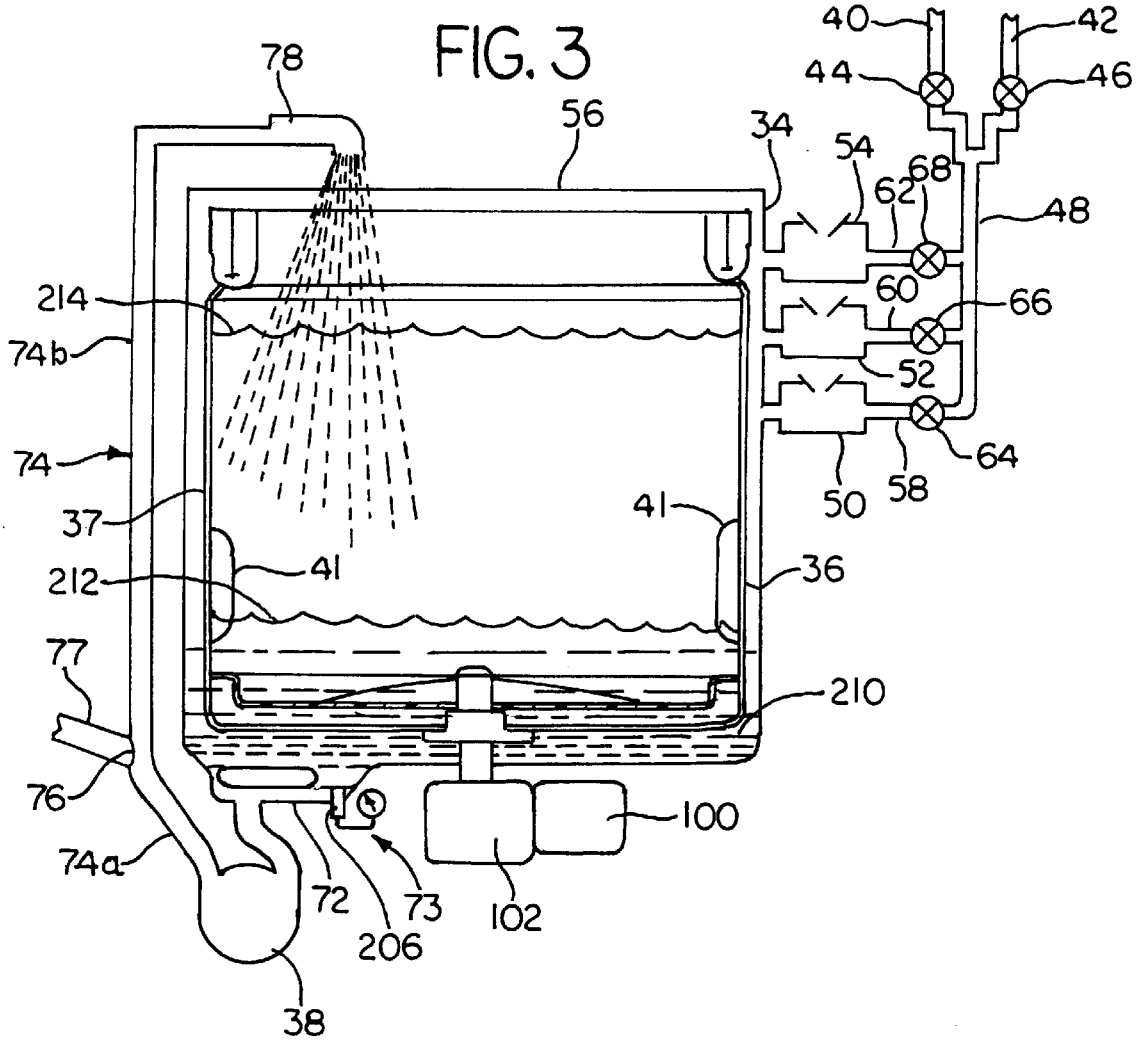
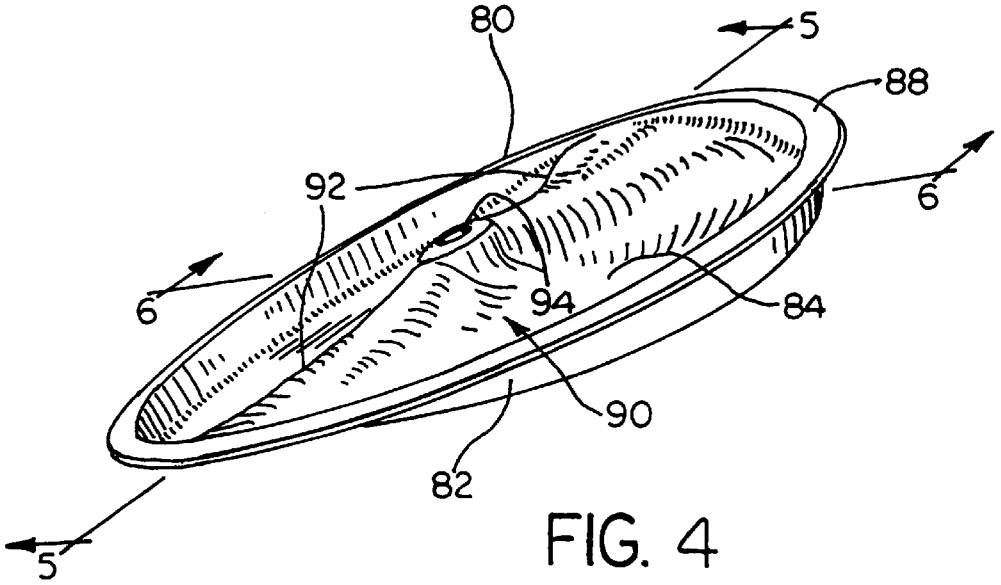
FIG. 4

VERTICAL AXIS WASHER AND A ROTATING WASHPLATE THEREFOR

This application claims the benefit of U.S. Provisional Application No. 60/028,062 filed on 4 Oct. 1996.

BACKGROUND OF THE INVENTION

1. Field of the Invention:

The present invention relates to a vertical axis clothes washer and more particularly to a vertical axis clothes washer having a rotating bottom plate for agitating clothing in the washer.

2. Description of the Related Art:

Attempts have been made to provide an improved automatic clothes washer which uses less energy and water, while providing comparable or superior wash results of present commercially available automatic washers. For example, such an improved washer may advantageously employ the system and processes shown and described in U.S. Pat. Nos. 4,784,666, 4,987,627, and 5,460,018, assigned to the assignee of the present invention, and incorporated herein by reference.

The basis of these systems stems from the optimization of the equation where wash performance is defined by a balance between the chemical (the detergent efficiency and water quality), thermal (energy to heat water), and mechanical (application of fluid flow through—fluid flow over—fluid impact—fabric flexing) energy inputs to the system. Experience has shown that any reduction in one or more energy forms requires an increase in one or more of the other energy inputs to produce comparable levels of wash performance.

Typically, a conventional vertical axis washer functions by loading fabric items to be washed into a vertically oriented wash basket disposed within a wash tub and further having a vertically orientated agitator centrally supported within the wash basket. Detergent and water are supplied into the tub and basket for forming a wash liquid such that the fabric items are completely submerged in wash liquid, and wherein the oscillation of the agitator causes the clothes to move in the wash liquid within the wash basket. In this configuration, the detergent provides a chemical energy input, the introduction of hot/warm water for mixing with the detergent provides a thermal energy input, and the action of the agitator provides a mechanical energy input, whereby all of these energy inputs act together to remove soil from the fabric items.

Traditionally, this system of washing requires a large amount of water, as much as 46 gallons for one clothes load, to suitably wash clothes. This is due to the fact that for the oscillating agitator to properly apply mechanical energy to the clothes without damaging them, all of the fabric items must be substantially submerged in wash liquid. The agitator imparts mechanical energy to the clothing by direct contact and agitation of the water. This complete submersion of the fabric items occurs during the wash cycle and each of the subsequent rinse cycles.

In addition to an oscillating agitator, it is also known for automatic washers using a submersion method to include a rotatable plate having one or more paddles disposed at the bottom of the wash basket to agitate the circulation of water within the wash basket to increase the movement of the clothing and their frictional interaction to add mechanical energy to the system. These systems are commonly referred to as impeller automatic washers. In impeller washers, very little, if any, of the mechanical energy is imparted from the impeller directly to the clothing. Almost all of the mechanical energy is imparted to the clothing through the agitation of the water. Examples of such impeller-type automatic washers are illustrated in U.S. Pat. Nos. 5,239,847, issued Aug. 31, 1993, 4,862,710, issued Sep. 5, 1989, and 2,575,691, issued Nov. 20, 1951.

U.S. Pat. No. 3,087,776, issued Apr. 30, 1963, discloses an automatic washer having a rotatable tub with an integral ramp whereby upon the rotation of the tub, clothing is dropped over the end of the ramp to agitate the clothing as it falls downwardly. Further, a transducer is positioned in the end of the ramp to impart vibratory movement via sound waves to the wash liquid to further agitate the clothing falling beyond the end of the ramp.

To substantially reduce the amount of wash liquid used in a vertical axis washer, alternate means for inputting mechanical energy to the wash load have been contemplated that do not require complete submersion of all the fabric items. Pending U.S. patent application Ser. No. 07/815,781, Kovich et.al., assigned to the assignee of the present invention and incorporated herein by reference, discloses a vertical axis washer utilizing a system for imparting mechanical energy into the fabric items wherein a substantial reduction in water consumption may be achieved. In this system the washer is provided with a basket having a ramp and baffle extending inwardly from the basket.

Other systems for imparting mechanical energy into fabric items clothes load in a vertical axis washer are also known. In U.S. Pat. No. 2,802,356 to Kirby, a vertical axis washer is provided wherein a wash basket is disposed within a tub. No agitator is provided for agitating the clothes, rather, the wash basket is mounted for providing a wobbly motion within the tub such that during the wash cycle, the basket is filled with wash liquid and is given a wobbling motion which agitates and distributes the clothes and thoroughly washes them.

In U.S. Pat. No. 2,145,453 to Miller a vertical axis washer is provided having a bottom plate mounted for gyratory motion within a wash tub. No wash basket is provided. During wash, the bottom plate is driven in a gyratory oscillating movement such that the clothes are agitated. Miller teaches the complete submersion of the fabric item within wash liquid during the wash cycle.

Significantly greater savings in water usage and energy usage than is achieved by heretofore disclosed vertical axis wash systems are highly desirable and would be an improvement in the art. Furthermore, it would be a significant improvement in the art to provide a system for imparting mechanical energy to fabric items in a vertical axis washer without requiring complete submersion of the clothes with wash liquid.

BRIEF DESCRIPTION OF THE DRAWINGS

FIG. 3 is a schematic illustration of the fluid conduits and valves associated with the automatic washer of the present invention.

FIG. 4 is a perspective view of the rotatable wash plate according to the invention.

DESCRIPTION OF THE PREFERRED EMBODIMENTS

Figure 1:
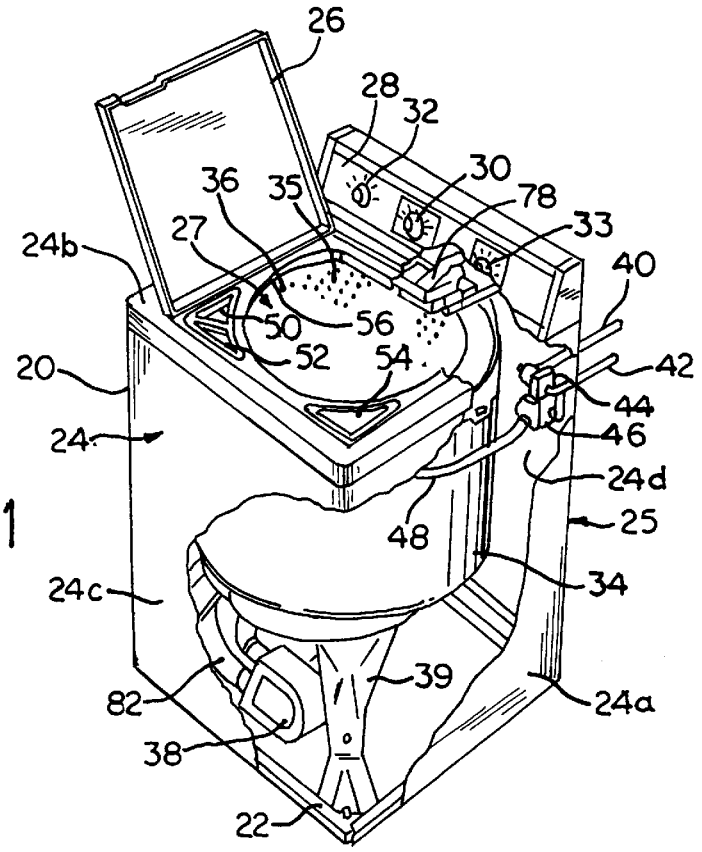
FIG. 1 is a perspective view of an automatic washer partially cut away to illustrate various interior components.
Figure 2:
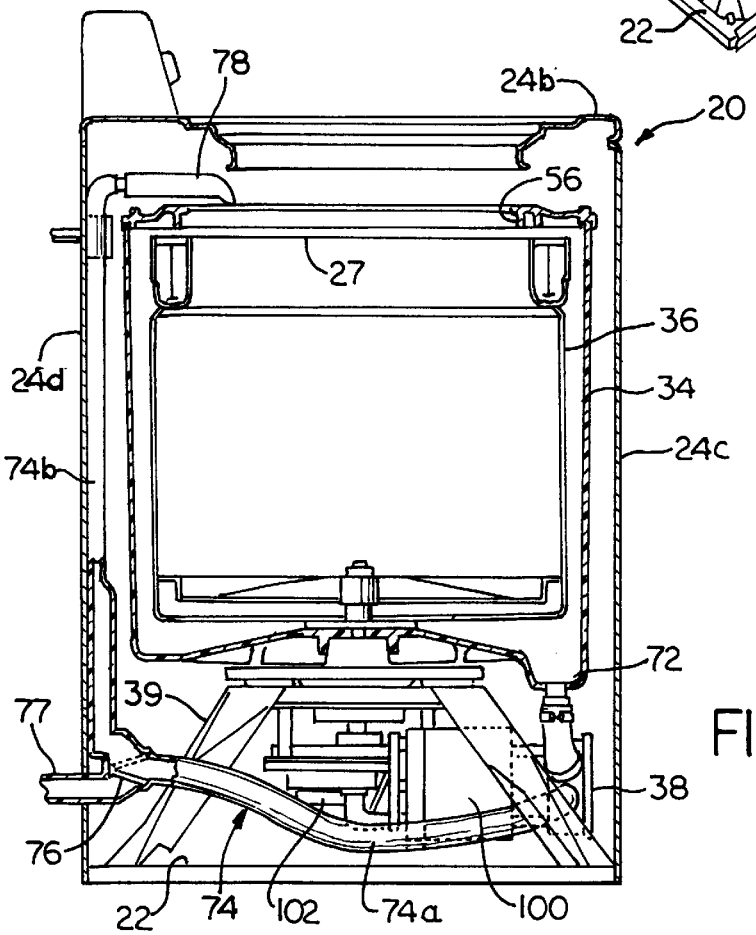
FIG. 2 is a side sectional view of the automatic washer of FIG. 1.

In FIGS. 1 and 2, reference numeral 20 indicates a washing machine of the automatic type, i.e., a machine having a pre-settable sequential control for operating a washer through a preselected wash cycle program of automatic washing, rinsing and drying operations in which the present invention may be embodied. The machine is preferably of the type that uses relatively low liquid levels during part or all of the wash cycle. Examples of low liquid Wash Cycles include: out-of-water Wash Cycle, where the clothing is not submerged in liquid; and a partially submerged or slosh Wash Cycle where the clothing is only partially submerged in liquid. To avoid confusion between the overall wash process and the portion in the process where the clothes are washed with detergent, for the purposes of this description, the term "Wash Cycle" defines the entire cleaning process, which can include, but is not limited to, various combinations of: a wash cycle, a rinse cycle, a spin cycle, and a drain cycle.

The machine 20 includes a frame 22 carrying vertical panels 24, forming the sides 24*a*, top 24*b*, front 24*c* and back 24*d* of a cabinet 25 for the washing machine 20. A hinged lid 26 is provided in the usual manner for access to the interior or treatment zone 27 of the washing machine 20. The washing machine 20 further has a console 28 including a timer dial 30 or other timing mechanism and a temperature selector 32 as well as a cycle selector 33 and other selectors as desired.

Internally of the machine 20 described herein by way of exemplification, there is disposed an imperforate fluid containing tub 34 within which is a wash basket 36 with perforations or holes 35. A pump 38 is provided below the tub 34. The wash basket 36 defines an open top wash chamber and includes a side wall 37. Baffles 41 are spaced about the cylindrical wall portion 37. A motor 100 is operatively connected to the wash basket 36 through a transmission 102 to rotate the wash basket 36 relative to the stationary tub 34. All of the components inside the cabinet 25 are supported by struts 39.

Water is supplied to the imperforate tub 34 by hot and cold water supply inlets 40 and 42. A hot water valve 44 and a cold water valve 46 are connected to manifold conduit 48. The manifold conduit 48 is interconnected to a plurality of wash additive dispensers 50, 52 and 54 disposed around a top opening 56 above the tub 34, just below the openable lid 26. As seen in FIG. 1, these dispensers are accessible when the hinged lid 26 is in an open position. Dispensers 50 and 52 can be used for dispensing additives such as bleach or fabric softeners and dispenser 54 can be used to dispense detergent (either liquid or granular) into the wash load at the appropriate time in the automatic wash cycle. As shown schematically in FIG.3, each of the dispensers 50, 52 and 54 is supplied with liquid (generally fresh water) through separate, dedicated conduits 58, 60, 62 respectively. Each of the conduits 58, 60, and 62 may be connected to a fluid source in a conventional manner, as by respective solenoid operated valves 64,66 and 68, which contain built-in flow devices to give the same flow rate of wide ranges on inlet pressures, connecting each conduit to the manifold conduit 48.

Disposed at the bottom of the tub 44 is a sump portion 72 for receiving wash liquid supplied into the tub through wash additive dispensers 50, 52 and 54. A multilevel pressure sensor 73 is disposed in the sump 72 for controlling the quantity of wash liquid added to the wash tub 34. The pump 38 is fluidly interconnected with the sump 72 and is operable for drawing wash liquid from the sump 72 and moving wash liquid through a recirculation line 74 having a first portion 74*a* and a second portion 74*b*. A 2-way drain valve 76 is provided in the recirculation line 74 for alternatively directing wash liquid flow to a drain line 77 or to the second portion 74*b* of the recirculation line 74.

A nozzle 78 is fluidly interconnected with the recirculation line 74. The nozzle 78 extends beyond the top opening 56 of the tub 34 and is positioned above the wash basket 36 such that wash liquid flowing through the recirculation line 74 is sprayed into the basket 36 and onto clothes disposed in the basket 36 below the nozzle 78. In this fashion, therefore, wash liquid may be recirculated over clothing disposed in the wash basket 36. Furthermore, the pressure sensor 73 may be operated during wash liquid recirculation for controlling the level of wash liquid in the tub 34 to be below the clothes load such that the clothes are not submerged in wash liquid as in a conventional washer. In this fashion, the clothes are washed in an out-of-water wash process as will be further described herein below.

FIG. 4 illustrates a wash plate 80 according to the invention and which is designed to operate in a low level wash cycle. The wash plate 80 has a low profile, pan-like body 82 defined by a generally flat bottom wall 84 and a substantially cylindrical peripheral wall 86 from which radially extends an annular lip 88. The lip abuts the wall 37 of the wash basket 36 to generally form a seal between the wash plate 80 and the wash basket 36, keeping clothing from being trapped therebetween during rotation of the wash plate 80.

A recess area 90 in the wash plate 80 is defined by the bottom wall 84 and the peripheral wall 86. A mounting collar 94 is centrally disposed and intregally formed with the bottom wall 84 and is adapted to receive the drive shaft of the gear reduction unit to couple the movement of the wash plate 80 to the movement of the motor 100. A pair of diametrically opposed ripples or ridges 92 are integrally formed in the bottom 84 and extend into the recess 90 between the mounting collar 94 and the peripheral wall 86.

Figure 5:
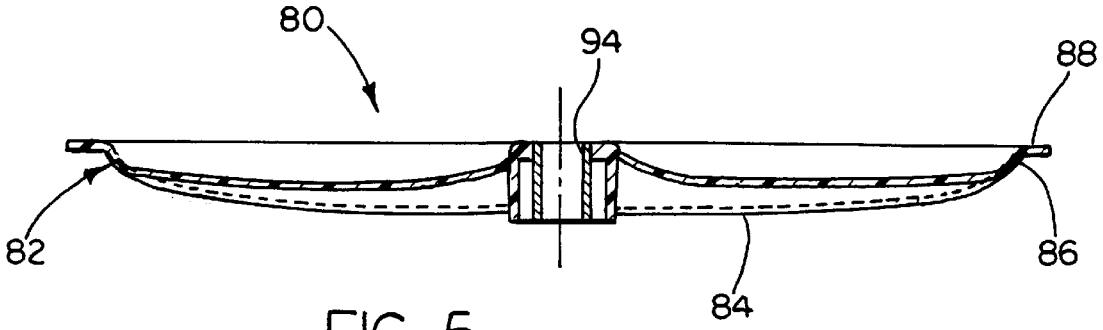
FIG. 5 is a sectional view of the wash plate of FIG.4 taken along lines 5—5.
Figure 6:
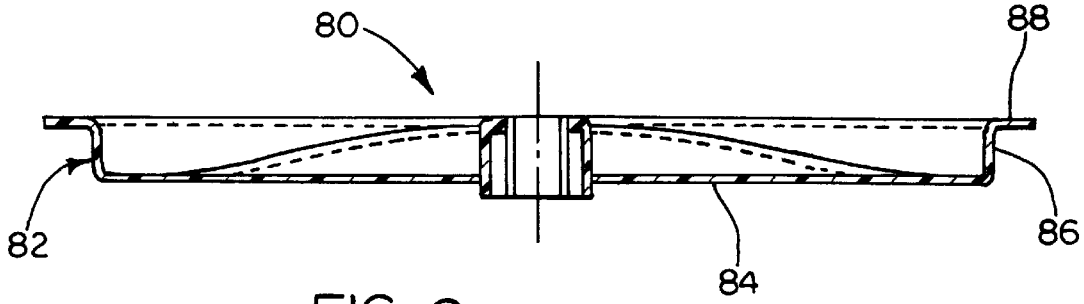
FIG. 6 is a sectional view of the wash plate of FIG.4 taken along lines 6—6 of FIG.4.

The shape of the ripples is such that they impart a vertical motion to the clothing as the wash plate 80 is oscillated (rotating between a clockwise and a counterclockwise direction) while reducing the tendency of the wash plate 80 to push or plow the clothing through the water. Thus, the wash plate flips or moves the clothing vertically to impart mechanical energy to the clothing. In a plan view as generally seen from FIG.4, the ripples 92 are generally triangular in shape and fan outwardly from the mounting collar 94 to the annular lip 88. The edges of the ripples 92 are blended into the body 82 to provide as smooth a contour as possible. The ripples 92 have a saddle-like surface contour that is best seen in FIG.5. The saddle-like contour begins from the mounting collar and slopes generally downward to a point approximately midway between the outer diameter of the annular collar and the inner diameter of the annular lip where it then begins to slope generally upward toward the annular lip. In a transverse view as best seen in FIG.6, the ripples 92 slope gently upward from the bottom wall 84 to the ridge line of the saddle.

The saddle shape of the ripple has the advantage of tending to move clothing at either radial extreme of the wash plate toward a central radial area of the wash plate. That is, clothing positioned near the mounting collar and the annular lip is directed radially toward a position interiorly of the mounting collar and the annular lip. The annular lip 88 is advantageous in that it provides a sealing function with the peripheral wall of the wash basket to inhibit clothing from being trapped between the wash plate 80 and the wash basket.

It is important that the clothing not remain in contact with the ripples 92 during rotation of the wash plate 80, especially when low liquid volumes, which occur in an out-of-water wash cycle or a partially submerged wash cycles, are used. With these low liquid volumes, the mechanical energy imparted to the clothing is derived mostly by the ripples 92 lifting and dropping the clothing as the wash plate rotates. Very little of the mechanical energy is derived from the forcing of liquid through the clothing by the rotation of the wash plate 80. Therefore, if the clothing remains in contact with the wash plate, e.g., the wash plate 80 pushes or plows the clothing, then an insufficient amount of mechanical energy will be imparted to the clothing, adversely impacting the cleanliness of the clothing.

Several characteristics of the shape of the ripple 92 improve its performance. The height of the ripple is a factor in the ripple directing the clothing vertically, instead of pushing the clothing. Testing has shown that the preferred height of the ripple is less than two inches. However, if the ripple is too short, it will not vertically lift the clothing, but will only agitate the water as does an impeller.

In addition to the height of the ripple, the slope of the sides of the ripple is an important factor to the proper functioning of the ripple. Testing has shown that the preferred angle at the mid point of the plate between the mounting collar 94 and the peripheral wall 86 is between 7 and 13 degrees. However, the preferred angle is also a function of the height and is 11 degrees for a ripple 1½ in height.

Figure 7:
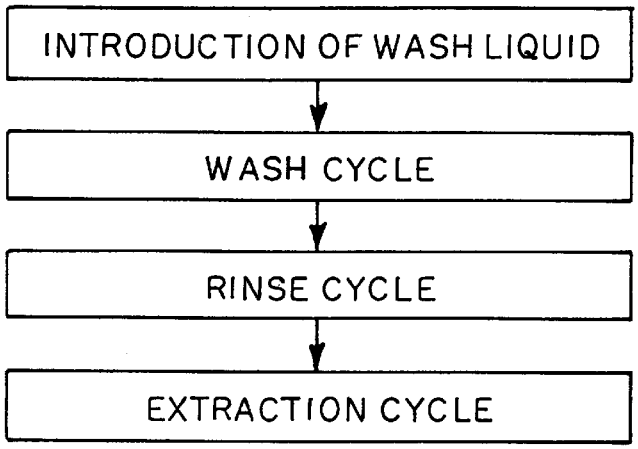
FIG. 7 is a flow chart diagram of the general steps in the wash cycle for an automatic washer.

FIG.7 illustrates the basic steps of operation for the automatic washer. In general, the automatic washer goes through four distinct cycles or steps to complete the Wash Cycle. For the purposes of discussion, it is assumed that a load of clothing has already been deposited in the wash basket by the user of the automatic washer 20. The first step 200 introduces the wash liquid (typically a mixture of water and detergent) into the treatment zone where the wash liquid is applied to the clothing deposited in the treatment zone 27. In step 202, the clothing having the applied wash liquid is then washed to remove and breakdown soil deposits on the clothing. Generally, the wash step 202 includes agitation of the clothing. After the wash step 202 is completed, the wash liquid containing the removed soil deposits is then rinsed from the clothing deposited in the wash zone 27. Upon completion of rinsing the clothing, liquid in the wash zone 27 is then removed during extraction step 206.

According to the invention, all of the general wash cycles steps 200–206 can be implemented at any one or combination of three preferred fill levels. The fill levels are best seen in FIG.3. Fill level 210 is a very low fill level and the liquid level preferably resides between the bottom of the wash basket 36 and the bottom of the wash tub 34. The low level fill is typically used in combination with the recirculation system so that the liquid between the wash basket and the wash tub is recirculated onto the clothing and the treatment zone 27. As used in this description, portions of the wash cycle using the low level fill 210 will be preceded by the phrase "out of water" as the clothing during that portion of the wash cycle is not in any way submerged in the liquid.

The second of the preferred fill levels is a partial fill level 212 in which the clothing in the wash treatment zone is at least partially submerged by the liquid in the wash tub 34. Typically, the partial fill level 212 will extend above the bottom of the wash basket 36 but the clothing will not be completely submerged in the liquid. At the partial fill level, because the clothing is not completely submerged, the buoyancy effect of the clothing is negligible and there is more wear because of direct contact with the wash plate. For purposes of this description, portions of the wash cycle using the partial fill level 212 will be preceded by the term "slosh".

The last of the preferred fill levels is the full fill level 214 in which the liquid in the wash tub is filled to approximately the top of the effective depth of the wash basket 36 so that the clothing in the treatment zone is completely submerged in the liquid. Thus, any portion of the wash cycle incorporating the full fill level will benefit from the buoyancy effect of the fully submerged clothing in that the wash plate will cause less wear and tear on the clothing during its operation. For purposes of this description, any portion of the wash cycle using a full fill level will be preceded by the term "deep fill".

Each of the four basic steps 200–206 of the cleaning cycle can comprise multiple sub-steps. Often, these sub-steps are in combination with different fill levels. For example, the introduction of the wash liquid step 200 can be a low level, highly concentrated, out of water step where water is introduced into the wash tub 34 through one of the wash additive dispensers (50, 52, 54) containing a detergent so that the detergent is mixed with the water as the water is filled to the low level fill 210. The highly concentrated wash liquid is then recirculated onto the clothing by the recirculation system where the pump 38 pumps the wash liquid from the wash tub through the recirculation conduit 74 and through the spray nozzle 78 onto the clothing in the wash basket. During the recirculation of the wash liquid, the clothing can be rotated under the spray nozzle 78 by either rotating the wash plate with respect to the spray nozzle 78 alone or in combination with rotating the wash basket 36 with respect to the spray nozzle 78.

The recirculation of the wash liquid during the introduction of the wash liquid can be used regardless of the fill level associated with the introduction of the wash liquid. The recirculation of the wash liquid is merely continued until the wash liquid reaches the desired fill level as determined by the multi-level pressure gauge 73. It is also contemplated that the recirculation will only continue for as long as is needed to completely soak the clothing, such as when the wash liquid level reaches the partial fill level, 212, at which time the pump 38 is turned off to prevent the recirculation of the wash liquid. The remaining water can be added directly to the wash tub by the appropriate conduit associated with the appropriate additive dispenser until the desired fill level is reached as determined by the multi-level pressure sensor 73.

Similarly, the wash cycle 202 can comprise various combinations of an out-of-water wash, slosh wash, and deep fill wash. Also, if an out-of-water or a slosh wash is being used, it is contemplated that there will be a periodic relative high speed (300 rpm) rotation of the wash basket for repositioning the clothing to the periphery of the basket .

The rinse cycle 204 can include a standard rinse wherein water is directed into the wash tub and sprayed onto the clothing via the pump 38, recirculation conduit 74 and spray nozzle 78, but is directly drained. Also, the rinse cycle can include a deep fill rinse and agitation with a subsequent drain. However, both of these methods use a relatively large volume of water. Therefore, as an alternative, it is contemplated to use one or more recirculation rinse cycles in which a low level fill of water, such as the out-of-water or slosh levels, is recirculated for a predetermined amount of time through the clothing and subsequently drained. The recirculation rinse is repeated until the clothing is thoroughly rinsed. Preferably, the extraction of liquid in step 206 is accomplished by rotating the wash plate and wash basket at a rate so that the centrifugal force of the rotation will force the liquid into the wash tub 34 were it is subsequently drained.

Figure 8:
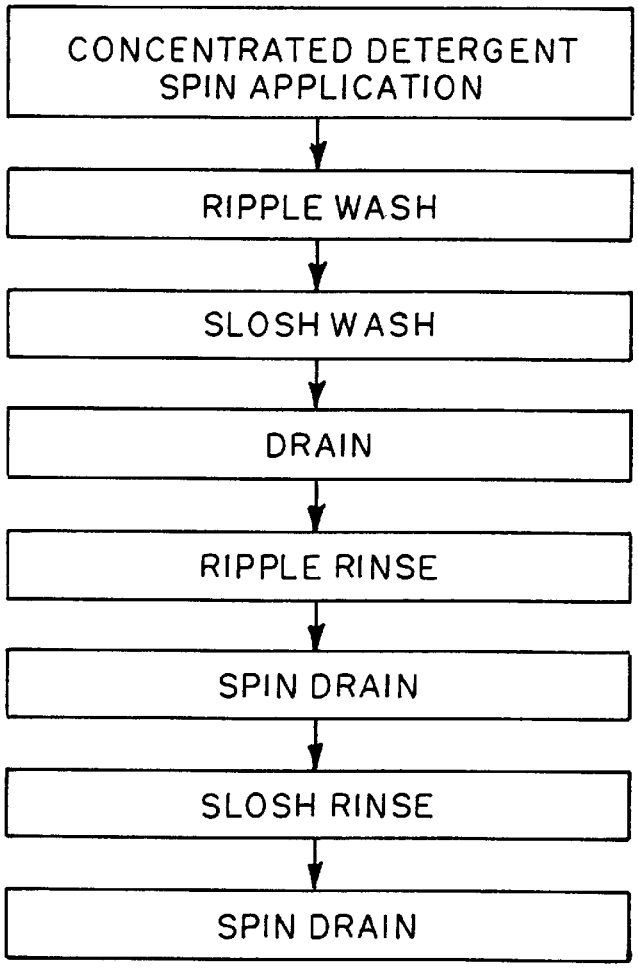
FIG. 8 is a flow chart diagram of the steps of the preferred wash cycle for the automatic washer according to the invention.

Although the Wash Cycle can incorporate any combination of the previously described cycles and other well-known cycles, FIG.8 discloses the preferred cleaning cycle for the invention, which takes best advantage of the wash plate. Once again, for purposes of this description, it is assumed that the user has already placed the clothing within the treatment zone of the automatic washer. The preferred Wash Cycle begins with a wash liquid introduction step comprising a concentrated detergent spin application step 220 in which the detergent is applied to the clothing in the treatment zone. A predetermined amount of water (approximately one and one-half gallons) is mixed with the detergent supplied by the user, preferable in one of the wash additive dispensers (50, 52, 54). The predetermined amount of water originates from the hot and/or cold inlets 40,42 and is directed through the manifold 48 to the wash additive dispenser 50, 52, or 54 that contains the detergent through one of the dedicated conduits 58, 60, 62. As the predetermined amount of water flows through the specified wash additive dispenser, it flushes the detergent from the wash additive dispenser into the bottom of the wash tub where it is mixed with the predetermined amount of water to form the wash liquid. The predetermined amount of water is generally a small enough volume so that the wash liquid does not rise above the low fill level.

The volume of water is measured by the multi-level pressure gauge. However, many other means of measuring the volume can be used, such as a meter placed in the manifold.

The wash liquid is then recirculated via the pump 38, recirculation conduit 74 and spray nozzle 78 so that it is sprayed onto the clothing positioned within the wash basket 36. During the spraying of the wash liquid, the wash basket is rotated at a relatively slow speed to move the clothing underneath the spray of the spray nozzle 78. The recirculating spraying of the clothing is continued until the level of the wash liquid achieves a generally consistent level indicating that the clothes are thoroughly saturated.

As an alternative to rotating the wash basket 36 during the spraying of the wash liquid from the spray nozzle 78, the wash plate can be rotated independently of and instead of the wash basket to move the clothes under the spray nozzle 78. If this method is used to rotate the clothing under the spray nozzle to ensure a thorough soaking of all the clothes and the treatment zone 27, it has been determined that the amount of water needed to thoroughly saturate the clothing is load dependent and typically greater than the one and one-half gallons as previously described, but typically less than four gallons.

After the clothes have been thoroughly saturated with the wash liquid, the clothing then undergo a ripple wash step 222. In this step, additional water, if needed, is supplied to the wash tub 36 until a continuous supply of water is provided to the pump 38, while the wash liquid is being continuously circulated. Generally, this condition is met when the wash liquid reaches a level around the low fill level 210. The total amount of water in the system is approximately four to six gallons.

During the ripple wash step 222, the wash plate is oscillated, i.e., rotated alternately in a clockwise and counterclockwise direction. Preferably, the wash plate is oscillated by turning on and off the PSC reversible motor. The wash plate is rotated at a rate of 120 to 180 RPM with motor on times of between two and five seconds. The exact rate of rotation and duration of rotation is dependent upon many factors, such as the inner diameter of the wash basket. However, the rate and duration are selected so that the clothing is directed vertically by the ripples on contact therewith, but does not carry the clothing with the ripple as it rotates. It is important to the invention that the clothing is not carried with the oscillating wash plate because the mechanical energy is supplied to the clothing by moving the clothing vertically and letting it fall. If the clothing is carried with the plate, then no mechanical energy is imparted to the clothing through the wash plate. This is especially important with low volumes of liquid because there will be no agitation of the liquid to impart mechanical energy to the clothing, like there is in traditional deep-fill washers using an agitator or an impeller to agitate the water.

The ripple wash step 222 is continued for approximately eight minutes. However, during the ripple wash step 222, it is contemplated that periodically the wash basket 36 and the wash plate will be rotated at a relatively high speed to reposition the clothing and to insure that the clothing is evenly distributed about the surface of the wash plate. The saddle shape of the ripples will tend to move the clothing toward the radial center of the wash plate. Similarly, the baffles will tend to prevent the clothing from piling or collecting near the outer periphery of the wash plate and to prevent the clothing from being carried in continuous contact with the wash plate.

After the ripple wash step 222 is completed, the slosh wash step 224 is initiated by adding water to the wash liquid until the wash liquid reaches the partially submerged level 212. The wash liquid is then recirculated in the same manner as with the ripple wash. Likewise, the wash plate is oscillated and the clothing is repositioned also in the same manner as with the ripple wash.

It is not necessary to use the slosh wash step 224 in combination with the ripple wash step 222 to clean the clothing in the treatment zone 27. However the combination of the ripple wash step 222 and the slosh wash step 224 provides a good compromise between the better clothing wear characteristics of the slosh wash step 224 and the increased detergency effect of the higher detergent concentrations associated with the ripple wash step 222. That is, the ripple wash step 222 could be used for a longer period of time without the slosh wash step 224 to obtain the same level of washability as the combined ripple wash step 222 and the slosh wash step 224. However, by only using the ripple wash step 222, there is increased wear and tear on the clothing because of the increased direct contact of the clothing with the wash plate that occurs with the extended ripple wash step 222 and the benefit from the buoyancy effect of the clothing in the slosh wash step 224.

Upon completion of the slosh wash step 224, the wash liquid is then drained from the wash tub 34 during drain step 226. The pump 38 is activated and the valve 76 is moved to open the drain conduit 74 so that the wash liquid in the wash tub 34 is removed from the wash tub 34 through the drain conduit 77. Optionally, the drain step 226 can further include a step where the wash basket and wash plate are rotated at a relatively high speed to remove the wash liquid remaining in the clothing by centrifugal force.

After the wash liquid is drained from the clothing in drain step 226, there is generally still some residual wash liquid in the clothing, which is removed by ripple rinse step 228. In ripple rinse step 228, water is added to the wash tub 34 through the dedicated conduit of the appropriate wash additive dispenser until the water level in the wash tub reaches the low level as determined by the pressure sensor 73. The rinse water is then recirculated and sprayed onto the clothing in the treatment zone 27, which is being moved under the spray nozzle 78 by the wash plate. Alternatively, it is possible that the ripple rinse step 228 could easily be replaced with a slosh rinse step or a deep fill rinse. However, although either of these rinse methods suitably rinse the residual wash liquid from the clothing, they do so by using an unnecessarily larger volume of water as compared to the ripple rinse.

After a predetermined amount of time, the ripple rinse step 228 is terminated and spin drain step 230 is initiated to drain the rinse liquid from the wash tub 34 by the pump 38 and directed through the drain conduit 77. As the rinse liquid is being drained by the pump 38, the wash basket 36 and the wash plate are rotated at a relatively high speed to extract as much rinse liquid as possible from the clothing by centrifugal force.

At the completion of the drain and spin drain step 230, the clothing is subjected to a second rinse step, a slosh rinse step 232. In the slosh rinse step 232, water is added to the wash tub 34 through a dedicated conduit associated with the appropriate wash additive dispenser until the level of the rinse liquid reaches the partially submerged level 212. If it is desired, it is at this point that it is most convenient to add a softener to the cleaning cycle. The softener would have been added to one of the wash additive dispensers 50, 52 and 54 by the user. The control for the automatic washer would automatically select the dedicated conduit associated with the wash additive dispenser containing the softener so the rinse water would flush the softener from the wash additive dispenser and thoroughly mix it with the rinse water. While the rinse water is being added to the wash tub 34, the recirculation system begins recirculating the rinse water and the wash plate is rotated under the spray nozzle 78 to insure a generally equal distribution of the rinse water on the clothing. The recirculation of the rinse water and the rotation of the wash plate is repeated for a predetermined amount of time.

At the end of the slosh rinse step 232, the rinse liquid is drained from the wash tub in the drain and spin extract step with spray rinses 234. The drain and spin extract step 234 is generally similar to the drain and spin extract step 230, except that after the majority of the rinse water is extracted by centrifugal force, the clothing undergoes one or more spray rinses. The spray rinse includes the introduction of water into the wash tub 34. The water is recirculated through the clothing for a predetermined amount of time while the clothing is being rotated at a relatively high rate of speed. The water is subsequently drained.

We claim:

1. An automatic washer for washing clothes, the automatic washer comprising:

an imperforate wash tub, a perforated wash basket provided within and rotatable relative to the wash tub, a rotatable wash plate with a bottom plate provided within and rotatable relative to the wash basket, a drive system connected to the wash basket and the wash tub for rotating the wash basket and the wash plate, and at least two ripples provided on and extending upwardly from the bottom plate of the wash plate, each ripple having a radially extending longitudinal axis, and each ripple further having a cross section that is generally transverse to the longitudinal axis, the cross section having sloped sides extending upwardly to define a ridgeline, the cross section being generally symmetrical about the longitudinal axis, the sloped sides of the cross section have approximately the same slope, and the ridgeline is generally convex providing the ripple with a contour wherein at least an end portion of the ripple is higher than a middle portion.

2. An automatic washer as claimed in claim 1, wherein the ripple has a saddle-shaped surface contour.

3. An automatic washer as claimed in claim 2, wherein the height of the ripple is less than two inches.

4. An automatic washer as claimed in claim 2, wherein the plan form of the ripple is sector-shaped.

5. An automatic washer as claimed in claim 2, wherein the wash plate has a peripheral wall extending upwardly from the peripheral edge of the bottom plate and a lip with a peripheral edge extending outwardly from the peripheral wall and the peripheral edge being in close proximity with the wash basket to form a seal between the wash basket and the wash plate to generally prevent clothing from being caught between the wash plate and the wash basket.

6. An automatic washer as claimed in claim 5, and further comprising at least one baffle positioned on the wash basket and extending over the wash plate.

7. An automatic washer as claimed in claim 5, wherein the wash plate has a central mounting collar and the ripple extends from the collar to the peripheral wall.

8. An automatic washer as claimed in claim 1, wherein there are an even number of ripples and the ripples are distributed about the wash plate in pairs of diametrically opposed ripples.

9. An automatic washer for washing clothes, the automatic washer comprising:

an imperforate wash tub, a perforated wash basket provided within and rotatable relative to the wash tub, a rotatable wash plate with a bottom plate provided within and rotatable relative to the wash basket, a drive system connected to the wash basket and the wash tub for rotating the wash basket and the wash plate, and at least two ripples provided on and extending upwardly from the bottom plate of the wash plate, each ripple having a radially extending longitudinal axis, and each ripple further having a cross section that is generally transverse to the longitudinal axis, the cross section having sloped sides extending upwardly to define a ridgeline, the cross section being generally symmetrical about the longitudinal axis, and each ripple having a saddle-shaped surface contour.

10. An automatic washer as claimed in claim 9, wherein the plan form of the ripple is sector-shaped.

11. An automatic washer as claimed in claim 9, wherein the ridgeline is generally convex.

12. An automatic washer as claimed in claim 11, wherein the wash plate has a peripheral wall extending upwardly from the peripheral edge of the bottom plate and a lip with a peripheral edge extending outwardly from the peripheral wall and the peripheral edge being in close proximity with the wash basket to form a seal between the wash basket and the wash plate to generally prevent clothing from being caught between the wash plate and the wash basket.

13. An automatic washer as claimed in claim 9, and further comprising at least one baffle positioned on the wash basket and extending over the wash plate.

14. An automatic washer as claimed in claim 11, further comprising at least one baffle positioned on the wash basket and extending over the wash plate.

15. An automatic washer for washing clothes, the automatic washer comprising:

an imperforate wash tub, a perforated wash basket provided within and rotatable relative to the wash tub, a rotatable wash plate with a bottom plate and a peripheral wall provided within and rotatable relative to the wash basket, a drive system connected to the wash basket and the wash tub for rotating the wash basket and the wash plate, and at least two diametrically opposed ripples provided on and extending upwardly from the bottom plate of the wash plate, each ripple having a saddle shaped surface contour defining opposing sloped walls, which extend radially from the center of the wash plate to the peripheral wall.

16. An automatic washer as claimed in claim 15, wherein the height of the ripple is less than two inches.

17. An automatic washer as claimed in claim 15, wherein the plan form of the ripple is sector-shaped.

18. An automatic washer as claimed in claim 15, wherein the angle of the sloped walls is between 7 and 13 degrees.

19. An automatic washer as claimed in claim 18, wherein the angle of the sloped walls is 11 degrees.

20. An automatic washer as claimed in claim 15, and further comprising at least one baffle positioned on the wash basket and extending over the wash plate.

21. An automatic washer as claimed in claim 15, wherein the baffle extends into the wash basket less than three inches.

22. An automatic washer as claimed in claim 15, wherein the wash plate has a lip with a peripheral edge extending outwardly from the peripheral wall and the peripheral edge being in close proximity with the wash basket to effectively form a seal between the wash basket and the wash plate to generally prevent clothing from being caught between the wash plate and the wash basket.

23. A wash plate for an automatic washer comprising an imperforate wash tub, a perforated wash basket provided within and rotatable relative to the wash tub, the wash plate comprising:

a bottom plate provided within and rotatable relative to the wash basket, and at least two ripples extending upwardly from the bottom plate of the wash plate, each ripple having a radially extending longitudinal axis, and each ripple further having a cross section that is generally transverse to the longitudinal axis, the cross section having sloped sides extending up to a point on a ridgeline, and the cross section being generally symmetrical about the longitudinal axis, the sloped sides of the cross section have approximately the same slope, and the ridgeline is generally convex providing the ripple with a contour wherein at least an end portion of the ripple is higher than a middle portion.

24. An automatic washer as claimed in claim 23, wherein the ripple has a saddle-shaped surface contour.

25. An automatic washer as claimed in claim 24, wherein the height of the ripple is less than two inches.

26. An automatic washer as claimed in claim 23, wherein the plan form of the ripple is sector-shaped.

27. A wash plate for an automatic washer comprising an imperforate wash tub, a perforated wash basket provided within and rotatable relative to the wash tub, the wash plate comprising:

a bottom plate provided within and rotatable relative to the wash basket, and at least two ripples extending upwardly from the bottom plate of the wash plate, each ripple having a radially extending longitudinal axis, and each ripple further having a cross section that is generally transverse to the longitudinal axis, the cross section having sloped sides extending up to a point on a ridgeline, and the cross section being generally symmetrical about the longitudinal axis; and a peripheral wall extending upwardly from a peripheral edge of the bottom plate and a lip with a peripheral edge extending outwardly from the peripheral wall and the peripheral edge being in close proximity with the wash basket to form a seal between the wash basket and the wash plate to generally prevent clothing from being caught between the wash plate and the wash basket.

28. An automatic washer as claimed in claim 23, wherein there are an even number of ripples and the ripples are distributed about the wash plate in pairs of diametrically opposed ripples.

29. A wash plate for an automatic washer comprising an imperforate wash tub, a perforated wash basket provided within and rotatable relative to the wash tub, the wash plate comprising:

a bottom plate and a peripheral wall provided within and rotatable relative to the wash basket, and at least two diametrically opposed ripples provided on and extending upwardly from the bottom plate of the wash plate, each ripple having a saddle shaped surface contour defining opposing sloped walls, which extend radially from the center of the wash plate to the peripheral wall.

30. An automatic washer as claimed in claim 29, wherein the height of the ripple is less than two inches.

31. An automatic washer as claimed in claim 30, wherein the plan form of the ripple is sector-shaped.

32. An automatic washer as claimed in claim 29, wherein the angle of the sloped walls is between 7 and 13 degrees.

33. An automatic washer as claimed in claim 32, wherein the angle of the sloped walls is 11 degrees.

34. An automatic washer as claimed in claim 29, and further comprising at least one baffle positioned on the wash basket and extending over the wash plate.

35. An automatic washer as claimed in claim 29, wherein the baffle extends into the wash basket less than three inches.

36. An automatic washer as claimed in claim 29, wherein the wash plate has a lip with a peripheral edge extending outwardly from the peripheral wall and the peripheral edge being in close proximity with the wash basket to effectively form a seal between the wash basket and the wash plate to generally prevent clothing from being caught between the wash plate and the wash basket.

* * * * *